US006110659A

United States Patent [19]

Hatakeyama et al.

[11] Patent Number: 6,110,659

[45] Date of Patent: Aug. 29, 2000

[54] THERMOGRAPHIC RECORDING ELEMENTS

[75] Inventors: Akira Hatakeyama, Kanagawa; Hiroshi Haraoka, Shizuoka, both of Japan

[73] Assignee: Fuji Photo Film Co., Ltd., Minami-Ashigara, Japan

[21] Appl. No.: 09/141,573

[22] Filed: Aug. 28, 1998

[30] Foreign Application Priority Data

Sep. 2, 1997 [JP] Japan ..... 9-252766

[51] Int. Cl.[7] ..... G03C 1/498

[52] U.S. Cl. ..... 430/617; 430/531; 430/533; 430/619; 430/627; 430/950

[58] Field of Search ..... 430/619, 617, 430/531, 533, 950, 627

[56] References Cited

U.S. PATENT DOCUMENTS

| | | | |
|---|---|---|---|
| 4,201,582 | 5/1980 | White . | |
| 5,223,384 | 6/1993 | Ohbayashi et al. | 430/538 |
| 5,415,993 | 5/1995 | Hanzalik et al. . | |
| 5,468,603 | 11/1995 | Kub | 430/619 |
| 5,695,920 | 12/1997 | Anderson et al. | 430/531 |

FOREIGN PATENT DOCUMENTS

| | | |
|---|---|---|
| 0803764A1 | 10/1997 | European Pat. Off. . |
| 50151138 | 12/1975 | Japan . |
| 53-116114 | 10/1978 | Japan . |
| 58-28737 | 2/1983 | Japan . |
| 96/15479A1 | 5/1996 | WIPO . |

*Primary Examiner*—Thorl Chea
*Attorney, Agent, or Firm*—Birch, Stewart, Kolasch & Birch, LLP

[57] ABSTRACT

A thermographic recording element has a polyester-containing undercoat layer on a support and a thermographic recording layer, typically a photosensitive layer, on the undercoat layer. The undercoat layer enhances the adhesion between the support and the recording layer.

21 Claims, No Drawings

THERMOGRAPHIC RECORDING ELEMENTS

This invention relates to thermographic recording elements and more particularly, to thermographic recording elements having improved adhesion between a support and a thermographic recording layer.

BACKGROUND OF THE INVENTION

Thermographic technology is well known. In thermographic recording elements having a photosensitive layer on a support, exposure is made to form latent images which are converted into visible images through heat development. The technology is disclosed, for example, in U.S. Pat. Nos. 3,152,904 and 3,457,075, D. Morgan and B. Shely, "Thermally Processed Silver Systems" in "Imaging Processes and Materials," Neblette, 8th Ed., Sturge, V. Walworth and A. Shepp Ed., page 2, 1969.

This technology well complies with the recently increasing social demand for simple processing and environmental protection.

In prior art photothermographic elements, photosensitive layers are formed by applying coating solutions based on organic solvents followed by drying. For example, U.S. Pat. No. 5,415,993 discloses a system of polyvinyl butyral as a binder in toluene and methyl ethyl ketone as a solvent. The use of organic solvents, however, is undesirable from the ecological and safety standpoints. One countermeasure which has been proposed is a technique of forming photosensitive layers using aqueous solvents. In connection with the aqueous coating of photosensitive layers, JP-A 116114/1978, 151138/1975 and 28737/1983, for example, disclose to use gelatin, polyvinyl alcohol, and polyvinyl acetal as the binder, respectively. These systems, however, fail to achieve satisfactory photographic performance. There is a demand to have a photothermographic element that is formed without using organic solvents which are undesirable from the ecological and safety standpoints, and the exhibits satisfactory photographic performance.

In general, the commodity value of photothermographic elements becomes very low if the adhesion between the photosensitive layer and the support is insufficient because images can be separated and lost on use. Therefore, there is a demand to have a photothermographic element that is formed using aqueous coating solutions and free of such drawbacks.

SUMMARY OF THE INVENTION

An object of the invention is to provide a thermographic recording element having improved adhesion between a support and a thermographic recording layer, typically a photosensitive layer.

Another object of the invention is to provide a thermographic recording element which is prepared by applying an aqueous solution which is desirable from the ecological and safety standpoints.

According to the invention, there is provided a thermographic recording element comprising a support, at least one polyester-containing undercoat layer on at least one surface of the support, and a thermographic recording layer on the undercoat layer.

Preferably, the thermographic recording layer includes a photosensitive layer containing a photosensitive silver halide, and the thermographic recording layer contains an organic silver salt and a reducing agent therefor. Further preferably, the photosensitive layer has been formed by applying a coating solution, followed by drying. In formulating the coating solution, a binder containing at least 50% by weight of the binder of a polymer latex is dispersed in a solvent containing at least 30% by weight of the solvent of water. The polymer latex preferably has an equilibrium moisture content of up to 2% by weight at 25° C. and RH 60%. Typically the photosensitive layer contains a styrene-diene copolymer.

The support is preferably formed of polyester.

DETAILED DESCRIPTION OF THE INVENTION

The thermographic recording element of the invention has at least one undercoat layer (subbing layer) on at least one surface of the support and a thermographic recording layer on the undercoat layer. The undercoat layer contains a polyester. The provision of the undercoat layer is effective for improving the adhesion between the support and the thermographic recording layer, typically a photosensitive layer (photothermographic layer).

In the thermographic recording element of the invention, the undercoat layer contains as a binder a polyester which is a polymer containing an ester bond structure between a polyhydric alcohol and a polybasic acid in its molecular chain. Examples of the polyhydric alcohol include ethylene glycol, propylene glycol, trimethylene glycol, 1,4-butane diol, cyclohexane-1,2-diol, and cyclohexane-1,4-diol. Examples of the polybasic acid include isophthalic acid, terephthalic acid, phthalic anhydride, 4-sulfophthalic acid, adipic acid, itaconic acid, and fumaric acid. Aqueous polyesters may also be used as the polyester according to the invention. The aqueous polyesters are obtained by emulsion polymerizing the above-described polyesters into emulsions or by introducing hydrophilic groups such as carboxyl and sulfonate groups into the polyesters to modify into hydrophilic ones. Therefore, the aqueous polyesters include a wear-soluble type, an emulsion dispersion type, and a colloid dispersion type as an intermediate of the first two types. Any of these types of aqueous polyesters may be used in the practice of the invention. With respect to the aqueous polyesters, reference is made to "Comprehensive Data of Water-Soluble Polymer Water Dispersed Type Resins," Keiei Kaihatsu Center, 1981.

The polyesters used herein preferably have a weight average molecular weight Mw of 2,000 to 200,000.

Examples of the polyester which can be used in the undercoat layer according to the invention are given below together with their weight average molecular weight Mw.

(P-1)

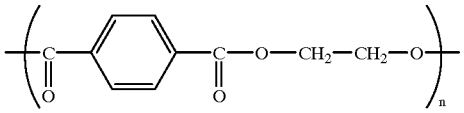

Mw = 23,000

(P-2)

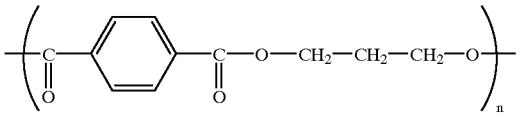

Mw = 14,000

(P-3)

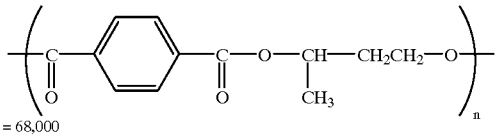

Mw = 68,000

(P-4)

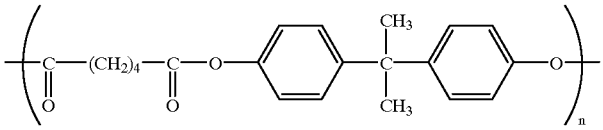

Mw = 9,000

(P-5)

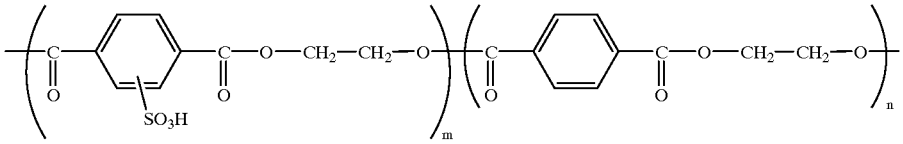

m:n = 15:85 (molar ratio)
Mw = 24,000

(P-6)

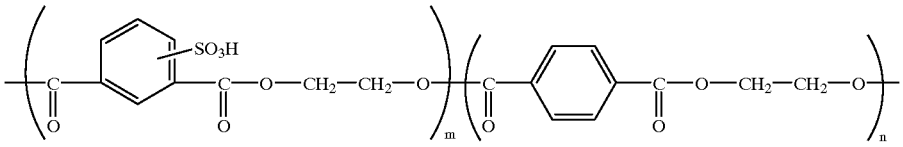

m:n = 25:75 (molar ratio)
Mw = 113,000

The polyesters which can be used in the undercoat layer according to the invention are commercially available under the trade name of Byron 200 and 300 from Toyobo K.K. Aqueous polyesters are commercially available under the trade name of Finetex ES525, ES611, ES650 and ES675 from Dai-Nippon Ink & Chemicals K.K., KP-1019, KP-1027 and KP-1029 from Matsumoto Yushi Seiyaku K.K., Plascoat Z-446, 710, 711, 766, 770, 802 and 857 from Goo Chemical Industry K.K., and Pesresin A123D and A515GB from Takamatsu Yushi K.K.

In the undercoat layer according to the invention, the polyester preferably accounts for at least 50%, more preferably at least 70% by weight of the entire binder.

In the undercoat layer, a polymer other than the polyester may be blended if necessary. Such additional polymers include water-soluble polymers such as gelatin and polyvinyl alcohol, and hydrophobic polymers such as polyethyl acrylate, polyvinylidene chloride, and polyurethane, to name a few.

The undercoat layer preferably has a thickness of 0.05 to 5 $\mu$m, more preferably 0.1 to 3 $\mu$m, per layer.

In addition to the binder, the undercoat layer may contain suitable components such as crosslinking agents, matte agents, dyestuffs, fillers and surfactants, if necessary.

Useful as the crosslinking agent are well-known compounds such as epoxy, isocyanate and melamine compounds. Active halogen crosslinking agents as described in JP-A 114120/1976 are also useful.

In the practice of the invention, it is preferred to use matte agents in the undercoat layer because they are effective for high-speed transportation. The preferred matte agents used herein are microparticulates of styrene, polymethyl methacrylate, silica and the like having a mean particle size of about 0.1 to 8 $\mu$m, more preferably about 0.2 to 5 $\mu$m. An appropriate amount of the matte agent used is about 1 mg to about 200 mg, more preferably about 2 mg to about 100 mg, per square meter of the thermographic recording element.

A useful filler is colloidal silica. The surfactants include anionic, nonionic and cationic surfactants. The dyestuffs include antihalation dyestuffs and tone-adjusting dyestuffs.

According to the invention, the undercoat layer may be formed by applying a coating solution of either aqueous or organic solvent system, followed by drying. From the cost and environment standpoints, it is preferred to form the undercoat layer by aqueous coating, that is, by applying an aqueous coating solution followed by drying. By the term "aqueous", it is meant that water accounts for at least 30% by weight, preferably at least 50% by weight, of the solvent or dispersing medium of the coating solution. Exemplary solvent compositions include a 85/15 mixture of water/methanol, a 70/30 mixture of water/methanol, a 80/15/5 mixture of water/methanol/dimethylformamide, and a 60/40 mixture of water/isopropyl alcohol, all expressed in a weight ratio, as well as water.

In forming the undercoat layer, no particular limits are imposed on the methods of applying and drying the coating solution. For application, well-known methods such as bar coating and dip coating may be used. Drying conditions include a temperature of about 25 to about 200° C. and a time of about 0.5 to about 20 minutes. Drying under such conditions is satisfactory.

The undercoat layer containing polyester may be a single layer or consist of two or more layers.

In addition to the polyester-containing undercoat layer, the thermographic recording element of the invention may have another undercoat layer which is free of polyester. For example, gelatin may be used as the binder for the other undercoat layer. In the other undercoat layer too, crosslinking agents, matte agents, dyestuffs, fillers and surfactants as mentioned above may be added if necessary. The other undercoat layer preferably has a thickness of 0.05 to 30 $\mu$m, more preferably 0.08 to 30 $\mu$m, per layer.

The polyester-containing undercoat layer is formed on the image-forming side, that is, thermographic recording layer-bearing side of a support as a layer underlying the thermographic recording layer. For the purpose of improving the adhesion between the support and the thermographic recording layer, the undercoat layer is preferably formed directly on the support as the layer interleaved between the support and the thermographic recording layer. Therefore, in the case of a double-side thermographic recording element having a thermographic recording layer on each surface of a support, the polyester-containing undercoat layer must be formed on each surface of the support.

While the thermographic recording element of the invention has the thermographic recording layer on the polyester-containing undercoat layer on the support, the thermographic recording layer preferably includes a photosensitive layer containing a photosensitive silver halide as an image-forming layer. Also preferably the thermographic recording layer contains an organic silver salt and a reducing agent for the organic silver salt.

The term "photosensitive layer" used herein is a silver halide-containing layer among layers constituting the thermographic recording layer in the photothermographic element of the invention. In the photothermographic element of the invention, one or more photosensitive layers may be included.

In the photothermographic element of the invention, the photosensitive layer typically contains a photosensitive silver halide in a binder. The binder used herein is not critical. Exemplary binders include polyvinyl butyral, polyvinyl acetal, cellulose acetate, cellulose acetate butyrate, polystyrene, polyvinyl alcohol, and gelatin, as well as polymers such as acrylic resins, polyester resins, rubbery resins (e.g., SBR resins), polyurethane resins, vinyl chloride resins, vinyl acetate resins, vinylidene chloride resins, and polyolefin resins. Of these polymers, the polymers which can be used in the form of a polymer latex are preferred. At least one of the photosensitive layers according to the invention, especially the photosensitive layer disposed in close contact with the undercoat layer should preferably contain a polymer latex as mentioned below in an amount of at least 50% by weight of the entire binder. With respect to the polymer latex, reference is made to Okuda and Inagaki Ed., "Synthetic Resin Emulsion," Kobunshi Kankokai, 1978; Sugimura, Kataoka, Suzuki and Kasahara Ed., "Application of Synthetic Latex," Kobunshi Kankokai, 1993; and Muroi, "Chemistry of Synthetic Latex," Kobunshi Kankokai, 1970. Inter alia, styrene-diene copolymers are preferred, with styrene-butadiene copolymers being especially preferred.

The styrene-diene copolymers (preferably styrene-butadiene copolymers) used herein are copolymers containing styrene and a diene (preferably butadiene) as copolymerized components. In the styrene-diene copolymers (preferably styrene-butadiene copolymers), the total content of styrene and a diene (preferably butadiene) is preferably about 50 to 100% by weight, more preferably about 80 to 99.5% by weight. When the styrene-diene copolymers (preferably styrene-butadiene copolymers) contain components other than the styrene-diene (preferably styrene-butadiene) component, such comonomer components are preferably acid monomers such as acrylic acid and itaconic acid and acrylate monomers such as methyl methacrylate and ethyl acrylate. Of these, copolymerization of acid monomers is especially preferred.

The polymers may be linear, branched or crosslinked. Also, either homopolymers having single monomers polymerized or copolymers having two or more different monomers polymerized are useful. The copolymers may be either random or block copolymers.

Preferably the polymers have a number average molecular weight Mn of about 5,000 to 1,000,000, more preferably about 10,000 to 1,000,000. Too low the molecular weight, the photosensitive layer would be given low mechanical strength. Polymers having a too high molecular weight are difficult to form a film.

In the polymer latex, the dispersed particles preferably have a mean particle size of about 1 to 50,000 nm, more preferably about 5 to 1,000 nm. No particular limits are imposed on the particle size distribution of dispersed particles in the polymer latex. The dispersion may have a wide particle size distribution or a monodisperse particle size distribution.

The polymer latex used herein may be either a latex of the conventional uniform structure or a latex of the so-called core/shell type. In the latter case, better results are sometimes obtained when the core and the shell have different glass transition temperatures.

The polymer latex should preferably have a minimum film-forming temperature (MFT) of about −30° C. to 90° C., more preferably about 0° C. to 70° C. A film-forming aid may be added in order to control the minimum film-forming temperature. The film-forming aid is also referred to as a plasticizer and includes organic compounds (typically organic solvents) for lowering the minimum film-forming temperature of a polymer latex. It is described in Muroi, "Chemistry of Synthetic Latex," Kobunshi Kankokai, 1970.

The polymer of the polymer latex used in the photosensitive layer of the photothermographic element according to the invention should preferably have an equilibrium moisture content of up to 2% by weight at 25° C. and RH 60%. The lower limit of the equilibrium moisture content is not critical although it is usually 0.01% by weight, preferably 0.03% by weight. With respect to the definition and measurement of equilibrium moisture content, reference should be made to "Polymer Engineering Series No. 14, Polymer Material Test Methods," Edited by Japanese Polymer Society, Chijin Shokan Publishing K.K., for example.

Illustrative preferred examples of the polymer latex are given below as L-1 to L-6 wherein numerical values are % by weight.

| Designation | Units |
|---|---|
| L-1 | -($St_{68}$-$Bu_{29}$-$AA_3$)- latex |
| L-2 | -($St_{59}$-$Bu_{39}$-$IA_2$)- latex |
| L-3 | -($St_{30}$-$MMA_{40}$-$Bu_{25}$-$MAA_5$)- latex |
| L-4 | -($MMA_{60}$-$2EHA_{38}$-$AA_2$)- latex |
| L-5 | -($St_{67}$-$CP_{30}$-$IA_3$)- latex |
| L-6 | -($St_{30}$-$VC_{40}$-$Bu_{15}$-$EA_{13}$-$IA_2$)- latex |

St: styrene
Bu: butadiene
AA: acrylic acid
IA: itaconic acid
MMA: methyl methacrylate
MAA: methacrylic acid
2EHA: 2-ethylhexyl acrylate
CP: chloroprene
VC: vinyl chloride
EA: ethyl acrylate These polymers are commercially available. Useful examples of the polymer latex which can be used herein include acrylic resins such as Sebian A-4635, 46583 and 4601 (Daicell Chemical K.K.) and Nipol Lx811, 814, 820, 821 and 857 (Nippon Zeon K.K.); polyester resins such as FINETEX ES650, 611, 675 and 850 (Dai-Nippon Ink & Chemicals K.K.) and WD-size and WMS (Eastman Chemical Products, Inc.); polyurethane resins such as HYDRAN AP10, 20, 30 and 40 (Dai-Nippon Ink & Chemicals K.K.); rubbery resins such as LACSTAR 7310K, 3307B, 4700H and 7132C (Dai-Nippon Ink & Chemicals K.K.) and Nipol Lx416, 410, 438C and 2507 (Nippon Zeon K.K.); vinyl chloride resins such as G351 and G576 (Nippon Zeon K.K.); vinylidene chloride resins such as L502 and L513 (Asahi Chemicals K.K.); and olefin resins such as Chemipearl S120 and SA100 (Mitsui Petro-Chemical K.K.).

These polymers may be used alone or in admixture of two or more if desired.

Silver halide

A method for forming the photosensitive silver halide according to the invention is well known in the art. Any of the methods disclosed in Research Disclosure No. 17029 (June 1978) and U.S. Pat. No. 3,700,458, for example, may be used. Illustrative methods which can be used herein are a method of adding a halogen-containing compound to a pre-formed organic silver salt to convert a part of silver of the organic silver salt into photosensitive silver halide and a method of adding a silver-producing compound and a halogen-providing compound to a solution of gelatin or another polymer to form photosensitive silver halide grains and mixing the grains with an organic silver salt. The latter method is preferred in the practice of the invention.

The photosensitive silver halide should preferably have a smaller grain size for the purpose of minimizing white turbidity after image formation. Specifically, the grain size is up to 0.20 $\mu$m, preferably 0.01 $\mu$m to 0.15 $\mu$m, most preferably 0.02 $\mu$m to 0.12 $\mu$m. The term grain size designates the length of an edge of a silver halide grain where silver halide grains are regular grains of cubic or octahedral shape. Where silver halide grains are tabular, the grain size is the diameter of an equivalent circle having the same area as the projected area of a major surface of a tabular grain. Where silver halide grains are not regular, for example, in the case of spherical or rod-shaped grains, the grain size is the diameter of an equivalent sphere having the same volume as a grain.

The shape of silver halide grains may be cubic, octahedral, tabular, spherical, rod-like and potato-like, with cubic and tabular grains being preferred in the practice of the invention. Where tabular silver halide grains are used, they should preferably have an average aspect ratio of from 100:1 to 2:1, more preferably from 50:1 to 3:1. Silver halide grains having rounded corners are also preferably used. No particular limit is imposed on the face indices (Miller indices) of an outer surface of silver halide grains. Preferably silver halide grains have a high proportion of {100} face featuring high spectral sensitization efficiency upon adsorption of a spectral sensitizing dye. The proportion of {100} face is preferably at least 50%, more preferably at least 65%, most preferably at least 80%. Note that the proportion of Miller index {100} face can be determined by the method described in T. Tani, J. Imaging Sci., 29, 165 (1985), utilizing the adsorption dependency of {111} face and {100} face upon adsorption of a sensitizing dye.

The halogen composition of photosensitive silver halide is not critical and may be any of silver chloride, silver chlorobromide, silver bromide, silver iodobromide, silver iodochlorobromide, and silver iodide. Silver bromide or silver iodobromide is preferred in the practice of the invention. Most preferred is silver iodobromide preferably having a silver iodide content of 0.1 to 40 mol %, especially 0.1 to 20 mol %. The halogen composition in grains may have a uniform distribution or a non-uniform distribution wherein the halogen concentration changes in a stepped or continuous manner. Preferred are silver iodobromide grains having a higher silver iodide content in the interior. Silver halide grains of the core/shell structure are also useful. Such core/shell grains preferably have a multilayer structure of 2 to 5 layers, more preferably 2 to 4 layers.

Preferably the photosensitive silver halide grains used herein contain at least one complex of a metal selected from the group consisting of rhodium, rhenium, ruthenium, osmium, iridium, cobalt, and iron. The metal complexes may be used alone or in admixture of two or more complexes of a common metal or different metals. An appropriate content of the metal complex is $1\times10^{-9}$ to $1\times10^{-2}$ mol, more preferably $1\times10^{-2}$ to $1\times10^{-4}$ mol per mol of silver. Illustrative metal complex structures are those described in JP-A 225449/1995. Preferred among cobalt and iron complexes are hexacyano metal complexes. Illustrative, non-limiting examples of cobalt and iron complexes include hexacyano metal complexes such as ferrocyanate $[Fe(CN)_6]^{4-}$, ferricyanate $[Fe(CN)_6]^{3-}$, and hexacyanocobaltate $[Co(CN)_6]^{3-}$. The distribution of the metal complex in silver halide grains is not critical. That is, the metal complex may be obtained in silver halide grains uniformly or at a high concentration in either the core or the shell.

Photosensitive silver halide grains may be desalted by any of well-known water washing methods such as noodle and flocculation methods although silver halide grains may be either desalted or not according to the invention.

The photosensitive silver halide grains used herein should preferably be chemically sensitized. Preferred chemical sensitization methods are sulfur, selenium, and tellurium sensitization methods which are well known in the art. Also useful are a noble metal sensitization method using compound of gold, platinum palladium, and iridium and a reduction sensitization method. In the sulfur, selenium, and tellurium sensitization methods, any of compounds well known for the purpose may be used. For example, the compounds described in JP-A 128768/1995 are useful. Exemplary tellurium sensitizing agents include diacyltellurides, bis(oxycarbonyl)tellurides, bis(carbamoyl) tellurides, bis(oxycarbonyl)ditellurides, bis(carbomoyl) ditellurides, compounds having a P═Te bond, tellurocarboxylic salts, Te-organyltellurocarboxylic esters, di(poly) tellurides, tellurides, telluroles, telluroacetals, tellurosulfonates, compounds having a Pe—Te bond, Te-containing heterocyclics, tellurocarbonyl compounds, inorganic tellurium compounds, and colloidal tellurium. The preferred compounds used in the noble metal sensitization method include chloroauric acid, potassium chloroaurate, potassium aurithiocyanate, gold sulfide, and gold selenide as well as the compounds described in U.S. Pat. No. 2,448,060 and BP 618,061. Illustrative examples of the compound used in the reduction sensitization method include ascorbic acid, thiourea dioxide, stannous chloride, aminoiminomethanesulfinic acid, hydrazine derivatives, boran compounds, silane compounds, and polyamine compounds. Reduction sensitization may also be accomplished by ripening the emulsion while maintaining it at pH 7 or higher or at pAg 8.3 or lower. Reduction sensitization may also be accomplished by introducing a single addition portion of silver ion during grain formation.

According to the invention, the photosensitive silver halide is preferably used in an amount of 0.01 to 0.5 mol, more preferably 0.02 to 0.3 mol, most preferably 0.03 to 0.25 mol per mol of the organic silver salt. With respect to a method and conditions of admixing the separately prepared photosensitive silver halide and organic silver salt, there may be used a method of admixing the separately prepared photosensitive silver halide and organic silver salt in a high speed agitator, ball mill, sand mill, colloidal mill, vibratory mill or homogenizer or a method of preparing an organic silver salt by adding a preformed photosensitive silver halide at any timing during preparation of an organic silver salt. Any desired mixing method may be used insofar as the benefits of the invention are fully achievable.

The photosensitive layer according to the invention preferably uses the above-mentioned polymer latex in an amount of at least 50%, more preferably at least 70% by weight of the entire binder therein.

Where the polymer latex is used as the binder in the photosensitive layer, any of hydrophilic polymers such as gelatin, polyvinyl alcohol, methyl cellulose, hydroxypropyl cellulose, carboxymethyl cellulose and hydroxypropyl methyl cellulose may be added. The amount of the hydrophilic polymer added is preferably up to 50%, more preferably up to 30% by weight of the entire binder in the photosensitive layer.

The total amount of the binder(s) in the photosensitive layer is preferably 0.2 to 30 g/m$^2$, more preferably 1 to 15 g/m$^2$, when expressed by the coverage of binder per square meter of the photothermographic element.

The photosensitive layer according to the invention is preferably formed by applying an aqueous coating solution, followed by drying. By the term "aqueous", it is meant that water accounts for at least 30% by weight of the solvent or dispersing medium of the coating solution. The component other than water of the coating solution may be a water-miscible organic solvent such as methyl alcohol, ethyl alcohol, isopropyl alcohol, methyl cellosolve, ethyl cellosolve, dimethylformamide, and ethyl acetate. Exemplary solvent compositions include a 90/10 mixture of water/methanol, a 70/30 mixture of water/methanol, a 90/10 mixture of water/ethanol, a 90/10 mixture of water/isopropanol, a 95/5 mixture of water/dimethylformamide, a 80/15/5 mixture of water/methanol/dimethylformamide, and a 90/5/5 mixture of water/methanol/dimethylformamide, all expressed in a weight ratio, as well as water.

In addition to the photosensitive silver halide, the photosensitive layer (or silver halide emulsion layer) according to the invention may contain other components such as reducing agents, organic silver salts, toners, and antifoggants, if desired. In the photosensitive layer according to the invention, there may be further added dyestuffs for tone adjustment, crosslinking agents for crosslinking, and surfactants for ease of coating.

Organic silver salt

The organic silver salt used herein is relatively stable to light, but forms a silver image when heated at 80° C. or higher in the presence of an exposed photocatalyst (as typified by a latent image of photosensitive silver halide) and a reducing agent. The organic silver salt may be of any desired organic compound containing a source capable of reducing silver ion. Preferred are silver salts of organic acids, typically long chain aliphatic carboxylic acids having at least 10 carbon atoms, more preferably 10 to 30 carbon atoms, especially 15 to 28 carbon atoms. Also preferred are complexes of organic or inorganic silver salts with ligands having a stability constant in the range of 4.0 to 10.0. The silver-providing substance preferably constitutes about 5 to 30% by weight of the image forming layer. Preferred organic silver salts include silver salts of organic compounds having a carboxyl group. Examples include silver salts of aliphatic carboxylic acids and silver salts of aromatic carboxylic acids though not limited thereto. Preferred examples of the silver salt of aliphatic carboxylic acid include silver behenate, silver stearate, silver oleate, silver laurate, silver caproate, silver myristate, silver palmitate, silver maleate, silver fumarate, silver tartrate, silver linolate, silver butyrate, silver camphorate and mixtures thereof.

Silver salts of compounds having a mercapto or thion group and derivatives thereof are also useful. Preferred examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-(ethylglycolamido)-benzothiazole, silver salts of thioglycolic acids such as silver salts of S-alkylthioglycolic acids wherein the alkyl group has 12 to 22 carbon atoms, silver salts of dithiocarboxylic acids such as a silver salt of dithioacetic acid, silver salts of thioamides, a silver salt of 5-carboxyl-1-methyl-2-phenyl-4-thiopyridine, silver salts of mercaptotriazines, a silver salt of 2-mercaptobenzoxazole as well as silver salts of 1,2,4-mercaptothiazole derivatives such as a silver salt of 3-amino-5-benzylthio-1,2,4-thiazole as described in U.S. Pat. No. 4,123,274 and silver salts of thion compounds such as a silver salt of 3-(3-carboxyethyl)-4-methyl-4-thiazoline-2-thion as described in U.S. Pat. No. 3,301,678. Compounds containing an imino group may also be used. Preferred examples of these compounds include silver salts of benzotriazole and derivatives thereof, for example, silver salts of benzotriazoles such as silver methyl-benzotriazole, silver salts of halogenated benzotriazoles such as silver 5-chlorobenzotriazole as well as silver salts of 1,2,4-triazole and 1-H-tetrazole and silver salts of imidazole and imidazole derivatives as described in U.S. Pat. No. 4,220,709. Also useful are various silver acetylide compounds as described, for example, in U.S. Pat. No. 4,761,361 and 4,775,613.

The organic silver salt which can be used herein may take any desired shape although needle crystals having a minor axis and a major axis are preferred. The inverse proportional relationship between the size of silver salt crystal grains and their covering power that is well known for photosensitive silver halide elements also applies to the photothermographic element of the present invention. That is, as organic silver salt grains constituting image forming regions of photothermographic element increase in size, the covering power becomes smaller and the image density becomes lower. It is thus necessary to reduce the grain size. In the practice of the invention, grains should preferably have a minor axis of 0.01 μm to 0.20 μm and a major axis of 0.10 μm to 5.0 μm, more preferably a minor axis of 0.01 μm to 0.15 μm and a major axis of 0.10 μm to 4.0 μm. The grain size distribution of the organic silver salt is desirably monodisperse. The monodisperse distribution means that a standard deviation of the length of minor and major axes divided by the length, respectively, expressed in percent, is preferably up to 100%, more preferably up to 80%, most preferably up to 50%. It can be determined from the measurement of the shape of organic silver salt grains using an image obtained through a transmission electron microscope. Another method for determining a monodisperse distribution is to determine a standard deviation of a volume weighed mean diameter. The standard deviation divided by the volume weighed mean diameter, expressed in percent, which is a coefficient of variation, is preferably up to 100%, more preferably up to 80%, most preferably up to 50%. It may be determined by irradiating laser light, for example, to organic silver salt grains dispersed in liquid and determining the auto-correlation function of the fluctuation of scattering light relative to a time change, and obtaining the grain size (volume weighed mean diameter) therefrom.

The organic silver salt is preferably added in an amount of about 0.1 to 20 g/m$^2$, more preferably about 1 to 15 g/m$^2$, as expressed by the coverage of organic silver salt per square meter of the thermographic recording element. In the photothermographic element of the invention, the total amount of silver coated is preferably about 0.05 to 15 g/m$^2$.

Reducing agent

The reducing agent for the organic silver salt may be any of substances, preferably organic substances, that reduce silver ion into metallic silver. Hindered phenols are preferred reducing agents. The reducing agent should preferably be contained in an amount of 1 to 10% by weight of the image forming layer. In a multi-layer construction wherein the reducing agent is added to a layer other than the photosensitive layer, the reducing agent is preferably added in a slightly larger amount of about 2 to 15% by weight of the layer.

For photothermographic elements using organic silver salts, a wide range of reducing agents are disclosed. Exemplary reducing agents include amidoximes such as phenylamidoxime, 2-thienylamidoxime, and p-phenoxyphenylamidoxime; azines such as 4-hydroxy-3,5-dimethoxybenzaldehydeazine; combinations of aliphatic carboxylic acid arylhydrazides with ascorbic acid such as a combination of 2,2-bis(hydroxymethyl)propionyl-β-phenylhydrazine with ascorbic acid; combinations of polyhydroxybenzenes with hydroxylamine, reductone and/or hydrazine, such as combinations of hydroquinone with bis(ethoxyethyl)hydroxylamine, piperidinohexosereductone or formyl-4-methylphenylhydrazine; hydroxamic acids such as phenylhydroxamic acid, p-hydroxyphenylhydroxamic acid, and β-anilinehydroxamic acid; combinations of azines with sulfonamidophenols such as a combination of phenothiazine with 2,6-dichloro-4-benzene-sulfonamidephenol; α-cyanophenyl acetic acid derivatives such as ethyl-α-cyano-2-methylphenyl acetate and ethyl-α-cyanophenyl acetate; bis-β-naphthols such as 2,2'-dihydroxy-1,1'-binaphthyl, 6,6'-dibromo-2,2'-dihydroxy-1,1'-binaphthyl, and bis(2-hydroxy-1-naphthyl)methane; combinations of bis-β-naphthols with 1,3-dihydroxybenzene derivatives such as 2',4'-dihydroxybenzophenone and 2,4-dihydroxyacetophenone; 5-pyrazolones such as 3-methyl-1-phenyl-5-pyrazolone; reductones such as dimethylaminohexosereductone, anhydrodihydroaminohexosereductone and anhydrodihydropiperidonehexosereductone; sulfonamidephenol reducing agents such as 2,6-dichloro-4-benzenesulfonamidephenol and p-benzenesulfonamidephenol; 2-phenylindane-1,3-dione, etc.; chromans such as 2,2-dimethyl-7-t-butyl-6-hydroxychroman; 1,4-dihydropyridines such as 2,6-dimethoxy-3,5-dicarboethoxy-1,4-dihydropyridine; bisphenols such as bis(2-hydroxy-3-t-butyl-5-methylphenyl)methane, 2,2-bis(4-hydroxy-3-methylphenyl)propane, 4,4-ethylidene-bis(2-t-butyl-6-methylphenol), 1,1-bis(2-hydroxy-3,5-dimethylphenyl)-3,5,5-trimethylhexane, and 2,2-bis(3,5-dimethyl-4-hydroxyphenyl)-propane; ascorbic acid derivatives such as 1-ascorbyl palmitate and ascorbyl stearate; aldehydes and ketones such as benzil and diacetyl; and 3-pyrazolidones and certain indane-1,3-diones.

Better results are sometimes obtained when an additive known as a "toner" for improving images is contained in addition to the above-mentioned components. The toners are well known in the photographic art as disclosed in U.S. Pat. No. 3,080,254, 3,847,612 and 4,123,282.

Examples of the toner include phthalimide and N-hydroxyphthalimide; cyclic imides such as succinimide, pyrazoline-5-one, quinazoline, 3-phenyl-2-pyrazolin-5-one, 1-phenylurazol, quinazoline and 2,4-thiazolidinedione; naphthalimides such as N-hydroxy-1,8-naphthalimide; cobalt complexes such as cobalt hexamine trifluoroacetate; mercaptans as exemplified by 3-mercapto-1,2,4-triazole, 2,4-dimercaptopyrimidine, 3-mercapto-4,5-diphenyl-1,2,4-triazole, and 2,5-dimercapto-1,3,4-thiadiazole; N-(aminomethyl)aryldicarboxyimides such as (N,N-dimethylaminomethyl)phthalimide and N,N-(dimethylaminomethyl)-naphthalene-2,3-dicarboxyimide; blocked pyrazoles, isothiuronium derivatives and certain optical bleach agents such as N,N'-hexamethylenebis(1-carbamoyl-3,5-dimethyl-pyrazole), 1,8-(3,6-diazaoctane)bis(isothiuroniumtrifluoroacetate) and 2-tribromomethylsulfonyl-benzothiazole; 3-ethyl-5-{(3-ethyl-2-benzothiazolinylidene)-1-methyl-ethylidene}-2-thio-2,4-oxazolidinedione; phthalazinone, phthalazinone derivatives or metal salts, or derivatives such as 4-(1-naphthyl)phthalazinone, 6-chlorophthalazinone, 5,7-dimethoxyphthalazinone and 2,3-dihydro-1,4-phthalazinedione; combinations of phthalazinone with phthalic acid derivatives (e.g., phthalic acid, 4-methylphthalic acid, 4-nitrophthalic acid, and tetrachlorophthalic anhydride); phthalazine, phthalazine derivatives or metal salts, or derivatives such as 4-(1-naphthyl)phthlazine, 6-chlorophthalazine, 5,7-dimethoxyphthalazine and 2,3-dihydrophthlazine; combinations of phthalazine with phthalic acid derivatives (e.g., phthalic acid, 4-methylphthalic acid, 4-nitrophthalic acid, and tetrachlorophthalic anhydride); quinazolinedione, benzoxazine or naphthoxazine derivatives; rhodium complexes which function not only as a tone regulating agent, but also as a source of halide ion for generating silver halide in situ, for example, ammonium hexachlororhodinate (III), rhodium bromide, rhodium nitrate and potassium hexachlororhodinate (III);

inorganic peroxides and persulfates such as ammonium peroxide disulfide and hydrogen peroxide; benzoxazine-2,4-diones such as 1,3-benzoxazine-2,4-dione, 8-methyl-1,3-benzoxazine-2,4-dione, and 6-nitro-1,3-benzoxazine-2,4-dione; pyrimidine and asymtriazines such as 2,4-dihydroxypyrimidine and 2-hydroxy-4-aminopyrimidine; azauracil and tetraazapentalene derivatives such as 3,6-dimercapto-1,4-diphenyl-1H,4H-2,3a,5,6a-tetraazapentalene, and 1,4-di(o-chlorophenyl)-3,6-dimercapto-1H,4H-2,3a,5,6a-tetraazapentalene. An appropriate amount of the toner added is 0.05 to 3 g, more preferably 0.5 to 1.5 g per g of silver.

In the practice of the invention, there may be used any of sensitizing dyes which can spectrally sensitize silver halide grains in a desired wavelength region when adsorbed to the silver halide grains. The sensitizing dyes used herein include cyanine dyes, merocyanine dyes, complex cyanine dyes, complex merocyanine dyes, holopolar cyanine dyes, styryl dyes, hemicyanine dyes, oxonol dyes, and hemioxonol dyes. Useful sensitizing dyes which can be used herein are described in Research Disclosure, Item 17643 IV-A (December 1978, page 23), ibid., Item 1831 X (August 1979, page 437) and the reference cited therein. It is advantageous to select a sensitizing dye having appropriate spectral sensitivity to the spectral properties of a particular light source of various laser imagers, scanners, image setters and printing plate-forming cameras.

Exemplary dyes for spectral sensitization to red light include compounds I-1 to I-38 described in JP-A 18726/1979, compounds I-1 to I-35 described in JP-A 75322/1944, and compounds I-1 to I-34 described in JP-A 287338/1995 for He—Ne lasers, and dyes 1 to 20 described in JP-b 39818/1980, compounds I-1 to I-37 described in JP-A 284343/1987, and compounds I-1 to I-34 described in JP-A 287338/1995 for LED light sources.

At any wavelength band in the range of 750 to 1,400 nm, silver halide grains may be spectrally sensitized. More particularly, photosensitive silver halide may advantageously be spectrally sensitized with various known dyes including cyanine, merocyanine, styryl, hemicyanine, oxonol, hemioxonol, and xanathene dyes. Useful cyanine dyes are cyanine dyes having a basic nucleus such as a thiazoline, oxazoline, pyrroline, pyridine, oxazole, thiazole, selenazole and imidazole nucleus. Preferred examples of the useful merocyanine dye contain an acidic nucleus such as a thiohydantoin, rhodanine, oxazolidinedione, thiazolinedione, barbituric acid, thiazolinone, malononitrile, and pyrazolone nucleous in addition to the above-mentioned basic nucleus. Among the above-mentioned cyanine and merocyanine dyes, those having an imino or carboxyl group are especially effective. A suitable choice may be made of well known dyes as described, for example, in U.S. Pat. No. 3,761,279, 3,719,495, and 3,877,943, BP 1,466,201, 1,469,117, and 1,422,057, JP-B 10391/1991 and 52387/1994, JP-A 341432/1993, 194781/1994, and 301141/1994. Especially preferred dye structures are cyanine dyes having a thioether bond-containing substituent group, examples of which are the cyanine dyes described in JP-A 58239/1987, 138638/1991, 138642/1991, 255840/1992, 72659/1993, 72661/1993, 222491/1994, 230506/1990, 258757/1994, 317868/1994, and 324425/1994, and Publication of International Patent Application No. 500926/1995.

These sensitizing dyes may be used along or in admixture of two or more. A combination of sensitizing dyes is often used for the purpose of supersensitization. In addition to the sensitizing dye, the emulsion may contain a dye which itself has no spectral sensitization function or a compound which does not substantially absorb visible light, but is capable of supersensitization. Useful sensitizing dyes, combinations of dyes showing supersensitization, and compounds showing supersensitization are described in Research Disclosure, Vol, 176, 17643 (December 1978), page 23, IV J and JP-B 25500/1974 and 4933/1968, JP-A 19032/1984 and 192242/1984.

The sensitizing dyes may be used in admixture of two or more. The sensitizing dye may be added to a silver halide emulsion by directly dispersing the dye in the emulsion or by dissolving the dye in a solvent and adding the solution to the emulsion. The solvent used herein includes water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol, N,N-dimethylformamide and mixtures thereof.

Also useful are a method of dissolving a dye in a volatile organic solvent, dispersing the solution in water or hydrophilic colloid and adding the dispersion to an emulsion as disclosed in U.S. Pat. No. 3,469,987, a method of dissolving a dye in an acid and adding the solution to an emulsion of forming an aqueous solution of a dye with the aid of an acid or base and adding it to an emulsion as disclosed in JP-B 23389/1969, 27555/1969 and 22091/1982, a method of forming an aqueous solution or colloidal dispersion of a dye with the aid of a surfactant and adding it to an emulsion as disclosed in U.S. Pat. No. 3,822,135 and 4,006,025, a method of directly dispersing a dye in hydrophilic colloid and adding the dispersion to an emulsion as disclosed in JP-A 102733/1978 and 105141/1983, and a method of dissolving a dye using a compound capable of red shift and adding the solution to an emulsion as disclosed in JP-A 74624/1976. It is also acceptable to apply ultrasonic waves to form a solution.

The time when the sensitizing dye is added to the silver halide emulsion according to the invention is at any step of an emulsion preparing process which has been ascertained effective. The sensitizing dye may be added to the emulsion at any stage or step before the emulsion is coated, for example, at a stage prior to the silver halide grain forming step and/or desalting step, during the desalting step and/or a stage from desalting to the start of chemical ripening as disclosed in U.S. Pat. No. 2,735,766, 3,628,960, 4,183,756, and 4,225,666, JP-A 184142/1983 and 196749/1985, and a stage immediately before or during chemical ripening and a stage from chemical ripening to emulsion coating as disclosed in JP-A 113920/1983. Also as disclosed in U.S. Pat. No. 4,225,666 and JP-A 7629/1983, an identical compound may be added alone or in combination with a compound of different structure in divided portions, for example, in divided portions during a grain forming step and during a chemical ripening step or after the completion of chemical ripening, on before or during chemical ripening and after the completion thereof. The type of compound or the combination of compounds to be added in divided portions may be changed.

In the practice of the invention, mercapto, disulfide and thion compounds may be added for the purposes of retarding or accelerating development to control development, improving spectral sensitization efficiency, and improving storage stability before and after development.

Where mercapto compounds are used herein, any structure is acceptable. Preferred are structures represented by Ar—S—M and Ar—S—S—Ar wherein M is a hydrogen atom or alkali metal atom, and Ar is an aromatic ring or fused aromatic ring having at least one nitrogen, sulfur, oxygen, selenium or tellurium atom. Preferred hetero-aromatic rings are benzimidazole, naphthimidazole, benzothiazole, naphthothiazole, benzoxazole, naphthoxazole, benzoselenazole, benzotellurazole, imidazole, oxazole, pyrrazole, triazole, thiadiazole, tetrazole, triazine, pyrimidine, pyridazine, pyrazine, pyridine, purine, quinoline and quinazolinone rings. These hetero-aromatic rings may have a substituent selected from the group consisting of halogen (e.g., Br and Cl), hydroxy, amino, carboxy, alkyl groups (having at least 1 carbon atom, preferably 1 to 4 carbon atoms), and alkoxy groups (having at least 1 carbon atom, preferably 1 to 4 carbon atoms). Illustrative, non-limiting examples of the mercapto-substituted hetero-aromatic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, and 2-mercapto-4-phenyloxazole.

These mercapto compounds are preferably added to the emulsion layer in amounts of 0.001 to 1.0 mol, more preferably 0.01 to 0.3 mol per mol of silver.

With antifoggants, stabilizers and stabilizer precursors, the silver halide emulsion and/or organic silver salt according to the invention can be further protected against formation of additional fog and stabilized against lowering of sensitivity during shelf storage. Suitable antifoggants, stabilizers and stabilizer precursors which can be used alone or in combination include thiazonium salts as described in U.S. Pat. No. 2,131,038 and 2,694,716, azaindenes as described in U.S. Pat. No. 2,886,437 and 2,444,605, mercury salts as described in U.S. Pat. No. 2,728,663, urazoles as described in U.S. Pat. No. 3,287,135, sulfocatechols as described in U.S. Pat. No. 3,235,652, oximes, nitrons and nitroindazoles as described in BP 623,448, polyvalent metal salts as described in U.S. Pat. No. 2,839,405, thiuronium salts as described in U.S. Pat. No. 3,220,839, palladium, platinum and gold salts as described in U.S. Pat. No. 2,566,263 and 2,597,915, halogen-substituted organic compounds as described in U.S. Pat. No. 4,108,665 and 4,442,202, triazines as described in U.S. Pat. No. 4,128,557, 4,137,079, 4,138,365 and 4,459,350, and phosphorus compounds as described in U.S. Pat. No. 4,411,985.

Preferred antifoggants are organic halides, for example, the compounds described in JP-A 119624/1975, 120328/1975, 121332/1976, 58022/1979, 70543,1981, 99335/1981, 90842/194, 129642/1986, 129845/1987, 208191/1994, 5621/1995, 2781/1995, 15809/1996, U.S. Pat. No. 5,340,712, 5,369,000, and 5,464,737.

The antifoggant may be added in any desired form such as solution, powder or solid particle dispersion. The solid particle dispersion of the antifoggant may be prepared by well-known comminuting means such as ball mills, vibrating ball mills, sand mills, colloidal mills, jet mills, and roller mills. Dispersing aids may be used for facilitating dispersion.

It is sometimes advantageous to add a memory (II) salt to an emulsion layer as an antifoggant though not necessary in the practice of the invention. Mercury (II) salts preferred to this end are mercury acetate and mercury bromide. The mercury (II) salt is preferably added in an amount of 1 nmol to 1 mmol, more preferably 10 nmol to 100 μmol per mol of silver coated.

Still further, the thermographic recording element of the invention may contain a benzoic acid type compound for the purposes of increasing sensitivity and restraining fog. Any of benzoic acid type compounds may be used although examples of the preferred structure are described in U.S. Pat. Nos. 4,784,939 and 4,152,160, Japanese Patent Application Nos. 98051/1996, 151241/1996, and 151242/1996. The benzoic acid type compound may be added to any site in the thermographic recording element, preferably to a layer on the same side as the photosensitive layer serving as the image forming layer, and more preferably an organic silver salt-containing layer. The benzoic acid type compound may be added at any step in the preparation of a coating solution. Where it is contained in an organic silver salt-containing layer, it may be added at any step from the preparation of the organic silver salt to the preparation of a coating solution, preferably after the preparation of the organic silver salt and immediately before coating. The benzoic acid type compound may be added in any desired form including powder, solution and fine particle dispersion. Alternatively, it may be added in a solution form after mixing it with other additives such as a sensitizing dye, reducing agent and toner. The benzoic acid type compound may be added in any desired amount, preferably 1 μmol to 2 mol, more preferably 1 mmol to 0.5 mol per mol of silver.

Hydrazine derivatives may be used in the present invention. Typical hydrazine derivatives used herein are compounds of the general formula (I) described in Japanese Patent Application No. 47961/1994, specifically compounds I-1 to I-53 described therein.

Other hydrazine derivatives are also preferred. Exemplary hydrazine derivatives include the compounds of the chemical formula [1] in JP-B 77138/1994, more specifically the compounds described on pages 3 and 4 of the same; the compounds of the general formula (I) in JP-B 93082/1994, more specifically compounds Nos. 1 to 38 described on pages 8 to 18 of the same; the compounds of the general formulae (4), (5) and (6) in JP-A 230497/1994, more specifically compounds 4-1 to 4-10 described on pages 25 and 26, compounds 5-1 to 5-42 described on pages 28 to 36, and compounds 6-1 to 6-7 described on pages 39 and 40 of the same; and the compounds of the general formulae (1) and (2) in JP-A 289520/1994, more specifically compounds 1-1 to 1-17 and 2-1 described on pages 5 to 7 of the same; the compounds of the chemical formulae [2] and [3] in JP-A 313936/1994, more specifically the compounds described on pages 6 to 19 of the same; the compounds of the chemical formula [1] in JP-A 313951/1994, more specifically the compounds described on pages 3 to 5 of the same; the compounds of the general formula (I) in JP-A 5610/1995, more specifically compounds I-1 to I-38 described on pages 5 to 10 of the same; the compounds of the general formula (II) in JP-A 77783/1995, more specifically compounds II-1 to II-102 described on pages 10 to 27 of the same; the compounds of the general formulae (H) and (Ha) in JP-A 104426/1995, more specifically compounds H-1 to H-44 described on pages 8 to 15 of the same; the compounds having an anionic group in proximity to a hydrazine group or a nonionic group forming an intramolecular hydrogen bond with the hydrogen atom of hydrazine described in Japanese Patent Application No. 191007/1995, specifically the compounds of the general formulae (A), (B), (C), (D), (E), and (F), more specifically compounds N-1 to N-30 described therein; and the compounds of the general formula (1) in Japanese Patent Application No. 191007/1995, more specifically compounds D-1 to D-55 described therein.

Hydrazine nucleating agents may be used by dissolving in suitable water-miscible organic solvents such as alcohols (e.g., methanol, ethanol, propanol, and fluorinated alcohols), ketones (e.g., acetone and methyl ethyl ketone), dimethylformamide, dimethylsulfoxide, and methyl cellosolve.

A well-known emulsifying dispersion method may be used for dissolving the hydrazine derivative with the aid of an oil such as dibutyl phthalate, tricresyl phosphate, glyceryl triacetate and diethyl phthalate or an auxiliary solvent such as ethyl acetate and cyclohexanone whereby an emulsified dispersion is mechanically prepared. Alternatively, a method known as a solid dispersion method is used for dispersing the hydrazine derivative in powder form in water in a ball mill, colloidal mill or ultrasonic mixer.

The hydrazine nucleating agent may be added to any layer on a support on the same side as a silver halide emulsion layer, that is, a silver halide emulsion layer on a support or any hydrophilic colloid layer on the same side, preferably to the silver halide emulsion layer or a hydrophilic colloid layer disposed adjacent thereto.

An appropriate amount of the nucleating agent is 1 $\mu$mol to 10 mmol, more preferably 10 $\mu$mol to 5 mmol, most preferably 20 $\mu$mol to 5 mmol per mol of silver halide.

If desired, the thermographic recording element of the invention further includes a non-image-forming layer. In one preferred embodiment of the invention, the thermographic recording element further includes a non-photosensitive layer.

The non-photosensitive layer contains a binder which is not critical. The binder used herein may be a polymer selected from gelatin, polyvinyl alcohol (PVA), casein, agar, gum arabic, hydroxyethyl cellulose, cellulose acetate, cellulose acetate butyrate, polyvinyl chloride, polymethacrylic acid, polyvinylidene chloride, and polyvinyl acetate, for example. Hydrophilic polymers, especially gelatin are preferred among others. The gelatin may be any of lime-treated gelatin, acid-treated gelatin and otherwise treated gelatin. Gelatin derivatives are also useful. A polymer latex of ethyl acrylate, for example, may be added to the hydrophilic polymer as the binder of the non-photosensitive layer.

The non-photosensitive layer preferably has a thickness of 0.1 to 10 $\mu$m, more preferably 0.5 to 5 $\mu$m.

The non-photosensitive layer is preferably formed by coating an aqueous coating solution and drying the coating as previously mentioned.

In the non-photosensitive layer, there may be added organic silver salts, reducing agent therefor, toners, antifoggants, matte agents, dyestuffs, lubricants, surfactants, etc. if necessary.

The thermographic recording element of the invention may further include a back layer or backing layer on the (back) surface of the support opposite to the surface on which the thermographic recording layers including a photosensitive layer are coated.

The back layer contains a binder which is not critical and may be selected from the polymers described in conjunction with the photosensitive layer and the non-photosensitive layer. It is preferred to use as the binder the polymer latexes described in conjunction with the photosensitive layer, especially latexes of polymers having an equilibrium moisture content of up to 2 wt % at 25° C. and RH 60%.

The back layer is preferably formed by coating an aqueous coating solution as previously described and drying the coating.

The back layer preferably exhibits a maximum absorbance of about 0.3 to 2.0, more preferably about 0.5 to 2.0 in the predetermined wavelength range. Further preferably, the back layer has an absorbance of 0.001 to less than 0.5 in the visible range after processing. More preferably the back layer is a layer having an optical density of 0.001 to less than 0.3.

In the back layer, there may be further added surfactants, crosslinking agents, lubricants, etc. if necessary. A backside resistive heating layer as described in U.S. Pat. Nos. 4,460,681 and 4,374,921 may also be formed.

The back layer preferably has a thickness of 0.1 to 20 $\mu$m, more preferably 0.5 to 10 $\mu$m.

In the thermographic recording element of the invention, a protective layer (back surface protective layer) may be formed on the back layer. Any desired binder may be used in the back surface protective layer. Any of the polymers described for the non-photosensitive layer may be used although hydrophilic polymers are preferred. The back protective layer is also preferably formed by coating an aqueous coating solution as previously described and drying the coating. If desired, matte agents, dyestuffs, lubricants, surfactants, and other components as previously described are added to the back protective layer. The back protective layer preferably has a thickness of 0.1 to 10 $\mu$m, more preferably 0.5 to 5 $\mu$m.

In the thermographic recording element of the invention, a variety of supports may be used. A choice may be made from well-known supports including polyesters (e.g., polyethylene terephthalate and polyethylene naphthalate), polyolefins (e.g., polyethylene and polypropylene), cellulose derivatives (e.g., cellulose diacetate and cellulose triacetate), styrenic polymers (e.g., polystyrene and poly-$\alpha$-methylstyrene), and polycarbonate. Among others, polyesters, especially biaxially oriented polyethylene terephthalate (PET) is preferred as the support from the standpoints of strength and cost. A polyester film is preferably stretched at a draw ratio of about 2 to 8, especially about 3 in both longitudinal and transverse directions. After stretching in both longitudinal and transverse directions, the film may be heat treated at about 80 to about 200° C. for about 10 seconds to about 20 minutes.

If desired, the support is dyed with any of well-known dyestuffs or pigments. The support is preferably dyed to such an extent that the dyed support may have an optical density of about 0.1 to 1.5, more preferably about 0.2 to 1.0 at the absorption wavelength of the dyestuff or pigment used.

The support used herein may be subject to surface treatment such as UV treatment, corona treatment, glow treatment or flame treatment, if desired. With respect to these surface treatments, reference is made to Tsunoda's report in "Collected Papers on Polymers," Vol. 35, page 229, 1978 and Hatada's report in "Surface Science," Vol. 5, page 408, 1984.

The support preferably has a thickness of 20 to 500 $\mu$m, more preferably 50 to 300 $\mu$m.

In constructing the thermographic recording element according to the invention, the thermographic recording layer can be formed by various coating procedures including dip coating, air knife coating, flow coating, and extrusion coating using a hopper of the type described in U.S. Pat. No. 2,681,294. If desired, two or more layers may be concurrently coated by the methods described in U.S. Pat. No. 2,761,791 and BP 837,095.

As mentioned above, the photosensitive layer and other constituent layers of the thermographic recording element according to the invention can be formed by the coating of aqueous solutions. A manufacturing method which is desirable from the standpoints of environmental protection and safety can be employed.

EXAMPLE

Examples of the present invention are given below by way of illustration and not by way of limitation.

Example 1

Preparation of undercoat coating solution A

An undercoat coating solution A was prepared by adding 0.1 g of polystyrene microparticulates having a mean particle size of 2.5 μm and 20 ml of a 1 wt % solution of Surfactant B to a water dispersion of a polyester (whose type is shown in Table 1). Distilled water was added to a total volume of 1,000 ml. The polyester water dispersion was used in such an amount as to give a coating thickness as shown in Table 1.

Preparation of undercoat coating solution B

An undercoat coating solution B was prepared by adding 300 ml of a water dispersion of a styrene-butadiene copolymer, 0.1 g of polyethylene microparticulates having a mean particle size of 2.5 μm and 10 ml of a 1 wt % solution of Surfactant B to 680 ml of water. The styrene-butadiene copolymer water dispersion contained styrene/butadiene/itaconic acid=47/50/3 (weight ratio) in a concentration of 30% by weight.

Preparation of undercoat coating solution C

An undercoat coating solution C was prepared by dissolving 10 g of inert gelatin in 970 ml of water and adding 20 ml of a 1 wt % solution of Surfactant B thereto.

Surfactant B

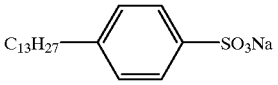

Preparation of subbed support

The support used was a biaxially oriented PET film of 180 μm thick tinted with a blue dyestuff. On one surface (photosensitive layer side) of the support, the undercoat coating solution A was applied by means of a bar coater so as to give a dry thickness as shown in Table 1, followed by drying at 180° C. for 5 minutes.

Next, on the back surface of the support, the undercoat coating solution B was applied by means of a bar coater so as to give a dry thickness of 0.3 μm, followed by drying at 180° C. for 5 minutes. Further, the undercoat coating solution C was applied onto the back undercoat by means of a bar coater so as to give a dry thickness of 0.1 μm, followed by drying at 180° C. for 5 minutes. The subbed support was completed in this way.

Preparation of organic silver salt dispersion A

A mixture of 40 grams of behenic acid, 7.3 grams of stearic acid, and 500 ml of water was stirred at a temperature of 90° C. for 15 minutes. Then, 187 ml of 1N NaOH aqueous solution was added over 15 minutes and 61 ml of 1N nitric acid aqueous solution added to the solution, which was cooled to 50° C. Next, 124 ml of 1N silver nitrate aqueous solution was added over 2 minutes to the solution, which was stirred for 30 minutes at the temperature. Thereafter, the solids were separated by suction filtration and washed with water until the water filtrate reached a conductivity of 30 μS/cm.

The thus collected solids were handled as wet cake without drying. To 100 g calculated as dry solids of the wet cake were added 10 grams of polyvinyl alcohol (trade name: PVA-205) and water. This was further diluted with water to a total weight of 500 g and pre-dispersed by a homomixer.

The pre-dispersed liquid was processed three times by a dispersing machine Micro-Fluidizer M-110S-EH (with G10Z interaction chamber, manufactured by Microfluidex International Corporation) which was operated under a pressure of 1,750 kg/cm$^2$. There was obtained a dispersion of organic acid silver microcrystalline grains having a volume weighed mean diameter of 0.93 μm as measured by Master Sizer X (Malvern Instruments Ltd.).

Preparation of silver halide grains A

In 700 ml of water were dissolved 22 grams of phthalated gelatin and 30 mg of potassium bromide. The solution was adjusted to pH 5.0 at a temperature of 40° C. To the solution, 159 ml of an aqueous solution containing 18.6 grams of silver nitrate and an aqueous solution containing potassium bromide were added over 10 minutes by the controlled double jet method while maintaining the solution at pAg 7.7. Then, 476 ml of an aqueous solution containing 55.4 grams of silver nitrate and an aqueous solution containing 8 μmol/liter of dipotassium hexachloroiridate and 1 mol/liter of potassium bromide were added over 30 minutes by the controlled double jet method while maintaining the solution at pAg 7.7. Desalting was then carried out by lowering the pH to cause agglomeration and sedimentation. With 0.1 gram of phenoxyethanol added, the emulsion was adjusted to pH 5.9 and pAg 8.0. There were obtained cubic grains having a mean grain size of 0.07 μm, a coefficient of variation of the projected area diameter of 8%, and a (100) face proportion of 86%.

The thus obtained silver halide grains A were heated at 60° C., to which 85 μmol of sodium thiosulfate, 11 μmol of 2,3,4,5,6-pentafluorophenyldiphenylphosphine selenide, 2 μmol of Tellurium Compound 1, 3.3 μmol of chloroauric acid, and 230 μmol of thiocyanic acid were added per mol of silver. The emulsion was ripened for 120 minutes.

Thereafter the temperature was lowered to 40° C. With stirring, $3.5\times10^{-4}$ mol of Sensitizing Dye A was added per mol of silver halide. After 5 minutes of stirring, $4.6\times10^{-3}$ mol of Compound A was added per mol of silver halide. After 5 minutes of stirring, the emulsion was quenched to 25° C., completing the preparation of silver halide grains A.

Note that Sensitizing Dye A, Compound A and Tellurium Compound 1 used herein have the following chemical structures.

Tellurium Compound 1

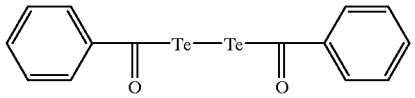

Sensitizing Dye A

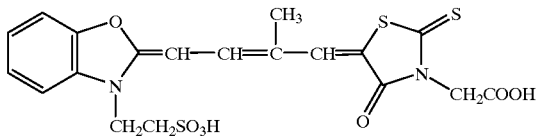

Compound A

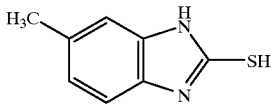

Solid particle dispersions of chemical addenda

Solid particle dispersions of tetrachlorophthalic acid, 4-methylphthalic acid, 1,1-bis(2-hydroxy-3,5-dimethylphenyl)-3,5,5-trimethylhexane, phthalazine, and tribromomethylphenylsulfone were prepared. To tetrachlorophthalic acid were added 0.81 gram of hydroxypropyl methyl cellulose and 94.2 ml of water. They were thoroughly agitated to form a slurry, which was allowed to stand for 10 hours. A vessel was charged with the slurry together with 100 ml of zirconia beads having a mean diameter of 0.5 mm. A dispersing machine as used above in the preparation of the organic acid silver grain dispersion was operated for 5 hours for dispersion, obtaining a solid particle dispersion of tetrachlorophthalic acid in which particles with a diameter of up to 1.0 $\mu$m accounted for 70% by weight. Solid particle dispersions of the remaining chemical addenda were similarly prepared by properly changing the amount of the dispersing agent and the dispersion time to achieve a desired mean particle size.

Preparation of emulsion layer coating solution 1

To the above-prepared organic silver salt grain dispersion A (corresponding to 1 mol of silver), the above-prepared silver halide grains A in an amount of 10 mol % of silver halide based on the organic acid silver and the binder and developing addenda described below were added, obtaining an emulsion layer coating solution 1.

Binder:

LACSTAR 3307B SBR latex 430 g

Developing addenda:

Tetrachlorophthalic acid 5 g 1,1-bis(2-hydroxy-3,5-dimethylphenyl)-3,5,5-trimethylhexane 98 g Phthalazine 9.2 g Tribromomethylphenylsulfone 12 g 4-methylphthalic acid 7 g It is noted that LACSTAR 3307B is a styrene-butadiene rubber (SBR) latex commercially available from Dai-Nippon Ink & Chemicals K.K. wherein the polymer has an equilibrium moisture content of 0.6 wt % at 25° C. and RH 60% and the dispersed particles have a mean particle diameter of about 0.1 to 0.15 $\mu$m.

Preparation of emulsion surface protective layer coating solution

A surface protective layer coating solution was prepared by adding 0.26 gram of Surfactant A, 0.09 gram of Surfactant B, 0.9 gram of silica microparticulates having a mean particle size of 2.5 $\mu$m, 0.3 gram of 1,2-bis(vinylsulfonylacetamide)ethane, and 64 grams of water to 10 grams of inert gelatin.

Surfactant A

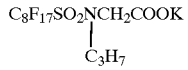

Surfactant B

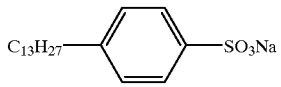

Preparation of dye dispersion

To 35 grams of ethyl acetate were added 2.5 grams of Dye B and 7.5 grams of Dye C, both shown below, followed by agitation until a solution was obtained. To this solution, 50 grams of an aqueous solution of 10% by weight polyvinyl alcohol was added. The mixture was agitated for 5 minutes by a homogenizer. Thereafter, the ethyl acetate was volatilized off for solvent removal. The residue was diluted with water, obtaining a dye dispersion.

Dye B

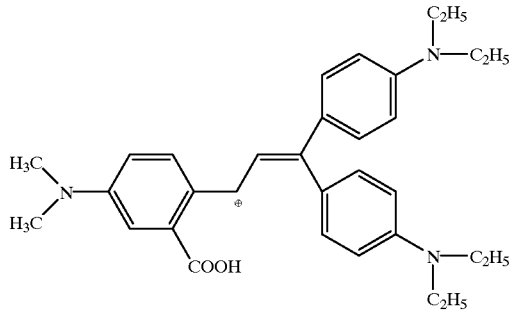

Dye C

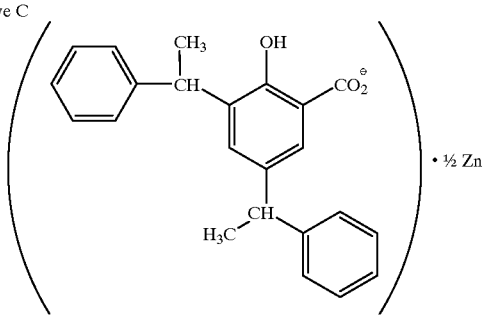

Preparation of back layer coating solution

A back layer coating solution was prepared by adding 50 grams of the above-prepared dye dispersion, 20 grams of Compound D, 250 grams of water and 1.8 grams of spherical silica Sildex H121 (mean particle size 12 $\mu$m, by Dokai Chemical K.K.) to 30 grams of polyvinyl alcohol.

Compound D

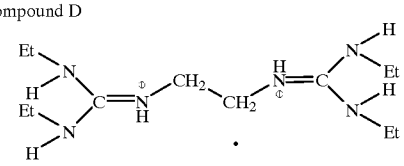

-continued

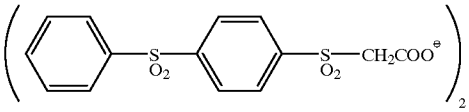

Preparation of coated sample

A coating solution was completed by adding additive dyes to the above-prepared emulsion layer coating solution 1. The amounts of the additive dyes added were adjusted so as to give the following coverages.

C.I. Pigment Blue 15:3 50 mg/m$^2$

C.I. Pigment Violet 23 50 mg/m$^2$

The manner of addition was selected from a technique of forming a solution of the dyes in an organic solvent and a technique of forming a solid particle dispersion of the dyes.

Onto the photosensitive layer side of the subbed support, the emulsion layer coating solution 1 and the emulsion surface protective layer coating solution were simultaneously applied in a slide bead manner. The emulsion layer coating solution was applied so as to give a silver coverage of 2.2 g/m$^2$, and the emulsion surface protective layer coating solution applied so as to give a gelatin coverage of 1.8 g/m$^2$. The coated sample was kept at 10° C. for 1 minutes and then dried at 35° C. for 5 minutes.

Next, onto the opposite (back) side of the support, the back layer coating solution was applied in a slide bead manner so as to give an optical density of 0.7 at 660 nm. The coating was kept at 10° C. for 1 minute and then dried at 35° C. for 5 minutes.

In this way, there were prepared samples as shown in Table 1.

The samples were tested for adhesion.

Adhesion Test

Using a razor, the surface of the sample on the same side as the photosensitive layer was scribed with size cut lines at a spacing of 4 mm in each of orthogonal directions, defining 25 square sections. The cut depth reached the support surface. A Mylar tape of 25 mm wide was attached to the scribed surface and fully pressed thereto. After 5 minutes from the pressure bonding, the tape was quickly pulled and peeled at a peeling angle of 180°. The number of peeled sections of the photosensitive layer was counted. This is a green adhesion test (prior to processing).

The sample was rated according to the following criterion.

| Rating | Number of peeled sections |
|---|---|
| A | 0 |
| B | 1 or less |
| C | less than 5 |
| D | or more |

Samples rated A or B are practically acceptable.

Separately, the coated sample was pressed onto a heating drum at 120° C. for 25 seconds for heat development. The thus processed sample was subject to the same adhesion test. This is a processed adhesion test.

The results are shown in Table 1.

TABLE 1

| Sample No. | Undercoat layer on photosensitive side: Layer | Binder | Thickness (μm) | Green adhesion | Processed adhesion |
|---|---|---|---|---|---|
| 101* | No | — | — | C | D |
| 102 | Yes | Finetex ES675 | 0.1 | A | A |
| 103 | Yes | Finetex ES675 | 0.3 | A | A |
| 104 | Yes | Finetex ES675 | 1.0 | A | A |
| 105 | Yes | Finetex ES675 | 3.0 | A | A |
| 106 | Yes | Pesresin A515GB | 0.1 | A | A |
| 107 | Yes | Pesresin A515GB | 0.3 | A | A |
| 108 | Yes | Pesresin A515GB | 1.0 | A | A |
| 109 | Yes | Pesresin A515GB | 3.0 | A | A |
| 110 | Yes | Pesresin A123D | 0.1 | A | A |
| 111 | Yes | Pesresin A123D | 0.3 | A | A |
| 112 | Yes | Pesresin A123D | 1.0 | A | A |
| 113 | Yes | Pesresin A123D | 3.0 | A | A |

Finetex ES675: aqueous polyester by Dai-Nippon Ink & Chemicals K. K.
Pesresin A515GB and A123D: aqueous polyesters by Takamatsu Yushi K. K.
*outside the scope of the invention As is evident from Table 1, the samples within the scope of the invention show improved adhesion between the support and the photosensitive layer. Separately, the samples were examined for photographic properties, finding no substantial difference in maximum density, fog, sensitivity and image color whether or not the samples had the undercoat layer. For the photographic test, exposure was made by means of a laser sensitometer having a 600-nm diode, and heat development was carried out at 120° C. for 15 seconds.

Example 2

Samples were prepared as in Example 1 except that the surfaces of the support were treated with a corona discharge before the undercoat layers were applied. The samples were tested as in Example 1, finding equivalent results corresponding to their construction.

Example 3

Samples were prepared as in Example 1 except that the formulation of undercoat coating solution A was changed as follows.

Preparation of undercoat coating solution A'

An undercoat coating solution A' was prepared by adding polymethyl methacrylate microparticulates (whose mean particle size and amount are shown in Table 2) as a matte agent and 10 ml of a 1 wt % solution of Surfactant C to a water dispersion of a polyester (whose type and amount are shown in Table 2). Distilled water was added to a total volume of 1,000 ml. The coating solution A' was applied onto the support so as to give a wet coating amount of 10 ml/m$^2$.

Surfactant C

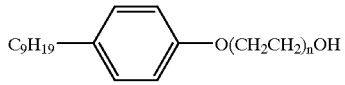

n ≈ 8.5

The samples were tested as in Example 1, with the results shown in Table 2.

TABLE 2

| Sample | Undercoat layer on photosensitive side | | | Matte agent | | Green | Processed |
|---|---|---|---|---|---|---|---|
| No. | Layer | Binder | Thickness (μm) | Mean particle size (μm) | Amount (mg/m²) | adhesion | adhesion |
| 301* | No | — | — | — | — | C | D |
| 302 | Yes | Pesresin A515GB | 0.3 | 0.5 | 30 | A | A |
| 303 | Yes | Pesresin A123D | 0.5 | 0.5 | 15 | A | A |
| 304 | Yes | Finetex ES675 | 0.8 | 0.5 | 30 | A | A |
| 305 | Yes | Finetex ES611 | 1.5 | 1.5 | 60 | A | A |
| 306 | Yes | P-1 | 0.3 | 2.5 | 5 | A | A |
| 307 | Yes | P-2 | 0.8 | 2.5 | 50 | A | A |
| 308 | Yes | P-3 | 2.0 | 0.5 | 5 | A | A |
| 309 | Yes | P-4 | 0.3 | 0.5 | 50 | A | A |
| 310 | Yes | P-5 | 0.8 | 1.5 | 5 | A | A |
| 311 | Yes | P-6 | 2.0 | 1.5 | 50 | A | A |

Finetex ES675 and ES611: aqueous polyesters by Dai-Nippon Ink & Chemicals K.K.
Pesresin A515GB and A123D: aqueous polyesters by Takamatsu Yushi K.K.
*outside the scope of the invention The benefits of the invention are evident from Table 2.

There has been described a thermographic recording element having a polyester-containing undercoat layer between a support and a thermographic recording layer, typically a photosensitive layer. The undercoat layer enhances the adhesion between the support and the overlying layer. The thermographic recording element can be prepared by the coating of aqueous solutions which are desirable from the standpoints of environmental protection and safety.

Japanese Patent Application No. 252766/1997 is incorporated herein by reference.

Reasonable modifications and variations are possible from the foregoing disclosure without departing from either the spirit or scope of the present invention as defined by the claims.

What is claimed is:

1. A thermographic recording element comprising a support, at least one undercoat layer on at least one surface of the support, and at least one thermographic recording layer on the undercoat layer, the thermographic recording layer containing an organic silver salt, a reducing agent therefor and a binder, or a photothermographic layer containing a photosensitive silver halide, an organic silver salt, a reducing agent therefor and a binder, wherein said undercoat layer contains a polyester as a binder and a matte agent.

2. The thermographic recording element of claim 1 wherein said thermographic recording layer has been formed by applying a coating solution in which the binder containing at least 50% by weight of the binder of a polymer is dispersed as a latex in a solvent containing at least 30% by weight of water as the solvent, followed by drying.

3. The thermographic recording element of claim 2 wherein the polymer has an equilibrium moisture content of up to 2% by weight at 25° C. and RH 60%.

4. The thermographic recording element of claim 2 wherein said polymer is a styrene-diene copolymer.

5. The thermographic recording element of claim 2, wherein said polymer comprises as least one selected from the group consisting of acrylic resin, rubbery resin, SBR resins, polyurethane resins, vinyl chloride resins, vinyl acetate resins, vinylidene chloride resins, polyolefin resins and styrene-diene copolymers.

6. The thermographic recording element of claim 5, wherein the styrene-diene copolymers comprise a total content of styrene and a diene of about 50 to 100% by weight.

7. The thermographic recording element of claim 6, wherein the diene comprises butadiene.

8. The thermographic recording element of claim 6, wherein the styrene-diene copolymers further comprise monomers selected from the group consisting of acrylic acid, itaconic acid, methyl methacrylate and ethyl acrylate.

9. The thermographic recording element of claim 1 wherein said support is of polyester.

10. The thermographic recording element of claim 9 wherein the support is a biaxially oriented PET film.

11. The thermographic recording element of claim 1 wherein said polyester is a polymer containing an ester bond structure between a polyhydric alcohol selected from the group consisting of ethylene glycol, propylene glycol, trimethylene glycol, 1,4-butane diol, cyclohexane-1,2-diol, and cyclohexane-1,4-diol and a polybasic acid selected from the group consisting of isophthalic acid, terephthalic acid, phthalic anhydride, 4-sulfophthalic acid, adipic acid, itaconic acid, and fumaric acid.

12. The thermographic recording element of claim 1 wherein an amount of said polyester is at least 50% by weight of the entire binder of the undercoat layer.

13. The thermographic recording element of claim 12 wherein an amount of said polyester is at least 70% by weight of the entire binder of the undercoat layer.

14. The thermographic recording element of claim 1 wherein said undercoat layer has a thickness of 0.05 to 5 μm per layer.

15. The thermographic recording element of claim 14 wherein said undercoat layer has a thickness of 0.1 to 3 μm per layer.

16. The thermographic recording element of claim 1 wherein said undercoat layer is formed by applying an aqueous coating solution of said polyester, followed by drying.

17. The thermographic recording element of claim 1 wherein said matte agent is microparticulates of styrene, polymethyl methacrylate, or silica having a mean particle size of 0.1 to 8 μm.

18. The thermographic recording element of claim 1 wherein an amount of the matte agent is 1 ml to 200 ml per square meter of the thermographic recording element.

19. The thermographic recording element of claim 1, wherein said polyester is obtained by emulsion polymerization.

20. The thermographic recording element of claim 1, wherein said polyester is made hydrophilic by introducing carboxyl and sulfonate groups into said polyester.

21. The thermographic recording element of claim 1, wherein said polyester is a colloid dispersion polyester.

* * * * *